US007277111B2

(12) United States Patent
Campbell et al.

(10) Patent No.: US 7,277,111 B2
(45) Date of Patent: Oct. 2, 2007

(54) MULTIPLE SPEED MODES FOR AN ELECTROPHOTOGRAPHIC DEVICE

(75) Inventors: Alan S. Campbell, Lexington, KY (US); Cary P. Ravitz, Lexington, KY (US); John P. Richey, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 213 days.

(21) Appl. No.: 11/046,038

(22) Filed: Jan. 28, 2005

(65) Prior Publication Data

US 2006/0170757 A1 Aug. 3, 2006

(51) Int. Cl.
*B41J 2/435* (2006.01)
*B41J 2/47* (2006.01)
*B41J 2/455* (2006.01)

(52) U.S. Cl. ..... 347/235; 347/232; 347/233; 347/234

(58) Field of Classification Search ..... 347/243, 347/232–235
See application file for complete search history.

(56) References Cited

U.S. PATENT DOCUMENTS 4,578,689 A 3/1986 Spencer et al.
4,899,176 A 2/1990 McQuade
5,223,952 A * 6/1993 Anzai ..... 358/451
5,229,790 A 7/1993 Matsuura et al.
5,321,432 A 6/1994 Ishikawa et al.
5,323,183 A 6/1994 Tateoka et al.
5,353,048 A 10/1994 Kanai
5,374,947 A * 12/1994 Takahashi et al. ..... 347/224
6,037,963 A * 3/2000 Denton et al. ..... 347/233
6,229,555 B1 5/2001 Hadady et al.
6,359,640 B1 3/2002 Ravitz et al.
6,504,147 B1 * 1/2003 Ito et al. ..... 250/234
2002/0135789 A1 9/2002 Ono
2002/0159791 A1 * 10/2002 Chen et al. ..... 399/167
2007/0002416 A1 * 1/2007 Choi et al. ..... 359/204

* cited by examiner

*Primary Examiner*—Hai Pham
*Assistant Examiner*—Kainoa Wright
(74) *Attorney, Agent, or Firm*—Stevens & Showalter, LLP

(57) ABSTRACT

An electrophotographic device comprises a printhead having at least one laser associated with a corresponding photoconductive surface. Where multiple laser beams are associated with the same photoconductive surface, the laser beams are spaced a predetermined distance from one another in a process direction, which is orthogonal to a scan direction in which the laser beams are swept. The electrophotographic device operates at one of at least two image transfer rates. A controller in the electrophotographic device selectively directs image data to the printhead based, at least in part, upon the selected image transfer rate, the facet resolution, and/or the desired output image resolution. The print speed can thus be adjusted over a relatively wide range.

26 Claims, 13 Drawing Sheets

Dual Laser Beam
Beam Scan Spacing: 3/600

One Third Image Transfer Speed
600 DPI Output Resolution

| | REV | REV | REV | REV | REV | REV |
|---|---|---|---|---|---|---|
| FACET | 1 | 2 | 3 | 4 | 5 | 6 |
| 1 | X | | | X | | |
| 2 | | X | | | X | |
| 3 | | | X | | | X |
| 4 | X | | | X | | |
| 5 | | X | | | X | |
| 6 | | | X | | | X |
| 7 | X | | | X | | |
| 8 | | X | | | X | |

FIG. 7

| Position | Facet | Diode | Revolution | 600 DPI | 900 DPI |
|---|---|---|---|---|---|
| **0** | F1 | D1 | 1 | X | X |
| | | | | | |
| 1/900 | F2 | D1 | 1 | | X |
| **1/600** | | | | | |
| 2/900 | F3 | D1 | 1 | | X |
| | | | | | |
| **1/300** | F4 | D1 | 1 | X | X |
| | | | | | |
| 4/900 | F5 | D1 | 1 | | X |
| **3/600** | F1 | D2 | 1 | X | |
| 5/900 | F6 | D1 | 1 | | X |
| | F2 | D2 | 1 | | |
| **2/300** | F7 | D1 | 1 | X | X |
| | F3 | D2 | 1 | | |
| 7/900 | F8 | D1 | 1 | | X |
| **5/600** | F4 | D2 | 1 | X | |
| 8/900 | F1 | D1 | 2 | | X |
| | F5 | D2 | 1 | | |
| **3/300** | F2 | D1 | 2 | X | X |
| | F6 | D2 | 1 | | |
| 10/900 | F3 | D1 | 2 | | X |
| **7/600** | F7 | D2 | 1 | X | |
| 11/900 | F4 | D1 | 2 | | X |
| | F8 | D2 | 1 | | |
| **4/300** | F5 | D1 | 2 | X | X |
| | F1 | D2 | 2 | | |
| 13/900 | F6 | D1 | 2 | | X |
| **9/600** | F2 | D2 | 2 | X | |
| 14/900 | F7 | D1 | 2 | | X |
| | F3 | D2 | 2 | | |
| **5/300** | F8 | D1 | 2 | X | X |
| | F4 | D2 | 2 | | |
| 16/900 | F1 | D1 | 3 | | X |
| **11/600** | F5 | D2 | 2 | | |
| 17/900 | F2 | D1 | 3 | | X |

FIG. 8

| | REV | REV | REV | REV | REV | REV |
|---|---|---|---|---|---|---|
| FACET | 1 | 2 | 3 | 4 | 5 | 6 |
| 1 | X | | | X | | |
| 2 | | X | | | X | |
| 3 | | | X | | | X |
| 4 | X | | | X | | |
| 5 | | X | | | X | |
| 6 | | | X | | | X |
| 7 | X | | | X | | |
| 8 | | X | | | X | |

FIG. 12

| Position | Facet | Diode | Revolution | Effective Scan Selected |
|---|---|---|---|---|
| **0** | F1 | D1 | 1 | X |
| | | | 1 | |
| 1/1800 | F2 | D1 | 1 | |
| **1/1200** | F1 | D2 | 1 | X |
| 2/1800 | F3 | D1 | 1 | |
| | F2 | D2 | 1 | |
| **1/600** | F4 | D1 | 1 | X |
| | F3 | D2 | 1 | |
| 4/1800 | F5 | D1 | 1 | |
| **3/1200** | F4 | D2 | 1 | X |
| 5/1800 | F6 | D1 | 1 | |
| | F5 | D2 | 1 | |
| **2/600** | F7 | D1 | 1 | X |
| | F6 | D2 | 1 | |
| 7/1800 | F8 | D1 | 1 | |
| **5/1200** | F7 | D2 | 1 | X |
| 8/1800 | F1 | D1 | 2 | |
| | F8 | D2 | 1 | |
| **3/600** | F2 | D1 | 2 | X |
| | F1 | D2 | 2 | |
| 10/1800 | F3 | D1 | 2 | |
| **7/1200** | F2 | D2 | 2 | X |
| 11/1800 | F4 | D1 | 2 | |
| | F3 | D2 | 2 | |
| **4/600** | F5 | D1 | 2 | X |
| | F4 | D2 | 2 | |
| 13/1800 | F6 | D1 | 2 | |
| **9/1200** | F5 | D2 | 2 | X |
| 14/1800 | F7 | D1 | 2 | |
| | F6 | D2 | 2 | |
| **5/600** | F8 | D1 | 2 | X |

FIG. 13

MULTIPLE SPEED MODES FOR AN ELECTROPHOTOGRAPHIC DEVICE

BACKGROUND OF THE INVENTION

The present invention relates in general to electrophotographic devices, and more particularly, to electrophotographic devices that support two or more image transfer rates and methods of operating electrophotographic devices at two or more image transfer rates.

In electrophotography, a latent image is created on the surface of an electrostatically charged photoconductive surface, e.g., a drum or belt, by exposing select portions of the photoconductive surface to laser light. Essentially, the density of the electrostatic charge on the photoconductive surface is altered in areas exposed to a laser beam relative to those areas unexposed to the laser beam. The latent electrostatic image thus created is developed into a visible image by exposing the photoconductive surface to toner, which typically contains pigment components and thermoplastic components. When so exposed, the toner is attracted to the photoconductive surface in a manner that corresponds to the electrostatic density altered by the laser beam. The toner is subsequently transferred from the photoconductive surface to a print medium such as paper, either directly or by using an intermediate transfer device. A fuser then applies heat and pressure to the print medium. The heat causes constituents including the thermoplastic components of the toner to flow into the interstices between the fibers of the medium and the fuser pressure promotes settling of the toner constituents in these voids. As the toner is cooled, it solidifies and adheres the image to the medium.

In a typical laser scanning system, a faceted rotating polygon mirror is used to sweep a laser beam across a photoconductive surface in a scan direction while the photoconductive surface advances in a process direction that is orthogonal to the scan direction. The polygon mirror speed is synchronized with the advancement of the photoconductive surface so as to achieve a desired image resolution, typically expressed in dots per inch (dpi) at a given image transfer rate, typically expressed in pages per minute (ppm). Thus, for example, to achieve a resolution of 600 dots per inch (236 dots per centimeter) in the process direction at an image transfer rate of 20 pages per minute, the photoconductive surface is operated at a speed sufficient to transfer toner images to twenty pages in one minute of time. Moreover, the polygon mirror velocity is configured to perform 600 scans across the photoconductive surface in the time it takes for the photoconductive surface to advance one inch (2.54 centimeters).

Slowing the operation of the photoconductive surface relative to a normal (full speed) operating image transfer rate can be desirable under certain circumstances. For example, slowing the photoconductive surface to one half of the full speed image transfer rate can provide double scan line addressability which, ideally, can improve the quality of the image printed on the medium. Additionally, by operating the photoconductive surface at half speed, greater time is available for fusing operations because the print medium is moving through the device at a slower speed. Relatively longer fusing times are desirable for example, when the print medium is relatively thick or where transparencies are used.

To operate satisfactorily at half speed, i.e., one half of the full speed image transfer rate, and to maintain double line addressability, the laser power needs to be reduced by one half of the full speed laser power so as to maintain output image consistency between full speed and half speed modes of printing. Unfortunately, the acceptable operating range of a typical laser diode may not allow such drastic changes in laser output power. As such, the prior art has attempted to reduce laser power output by using pulse width modulation of a full power laser beam such that the power output by the laser is reduced by one half. However, pulse width modulating a laser beam increases the complexity of the laser diode driver circuitry. Moreover, changing the duty cycle of a laser beam affects the "turn on" and "turn off" characteristics of the laser, which may affect overall consistency and print quality.

SUMMARY OF THE INVENTION

The present invention provides electrophotographic devices and methods of operating electrophotographic devices that are capable of operating at two or more image transfer rates such that the components of the laser system and paper feed path are operated within their normal ranges of operation. Further, a desired image characteristic, e.g., one or more of a predetermined process direction resolution and a total and/or average energy written to a photoconductive surface, is maintained regardless of the selected image transfer rate.

An electrophotographic device comprises a controller, a laser source, a photoconductive surface operable at two or more image transfer rates and a scanning device having a plurality of deflecting surfaces arranged to direct a beam from the laser source so as to sweep across the photoconductive surface in a scan direction. The laser source may alternatively include two or more laser devices, each capable of emitting an independently controllable laser beam. Where multiple beams are emitted from the laser source, the scanning device is further arranged to sweep each beam such that scan lines written by the beams are spaced from one another on the photoconductive surface by a predetermined beam scan spacing. The controller is arranged to maintain a desired image characteristic independent of a selected one of the image transfer rates by controlling the laser beam(s) so as to write image data only at select scan lines that have been identified from candidate scan lines. The candidate scan lines are defined by positions along the photoconductive surface that are determined at least by one or more of the selected image transfer rate, a predetermined rotational velocity of the scanning device, the number of independently controllable laser beams that may be swept across the photosensitive surface and their corresponding beam scan spacing.

A method is also provided of controlling an electrophotographic device that is capable of two or more image transfer rates such that a desired image characteristic is maintained independent of a selected one of the image transfer rates. The method comprises providing one or more laser beams and a scanning device having a plurality of deflecting surfaces arranged so as to sweep the laser beam(s) in a scan direction across the photoconductive surface. In a given sweep in which multiple laser beams are turned on or are otherwise modulated, the respective beams are spaced from one another on the photoconductive surface in a process direction that is nominally orthogonal to the scan direction by a predetermined beam scan spacing.

The scanning device is controlled to rotate at a predetermined velocity, and based upon a selected one of the image transfer rates, candidate scan lines are identified for laser beams and deflecting surfaces of the scanning device. Candidate scan lines thus essentially identify relative process direction positions from which the controller may opt to sweep a beam when writing image data to the photoconductive surface. The controller operates the laser source so as to write image data to the photoconductive surface at select ones of the candidate scan lines to achieve an output image corresponding to the desired image characteristic.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which:

FIG. 7 is a diagram illustrating the laser beam scan spacing illustrated in FIG. 6 as a function of facet pickoff of a rotating polygon mirror;

FIG. 8 is a diagram illustrating the laser beam scan spacing illustrated in FIG. 6 as a function of facet pickoff of a rotating polygon mirror;

FIG. 12 is a chart that illustrates the facet selection sequence for the laser beam of FIG. 9; and FIG. 13 is a diagram illustrating the laser beam scan spacing illustrated in FIG. 9 as a function of facet pickoff of a rotating polygon mirror.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
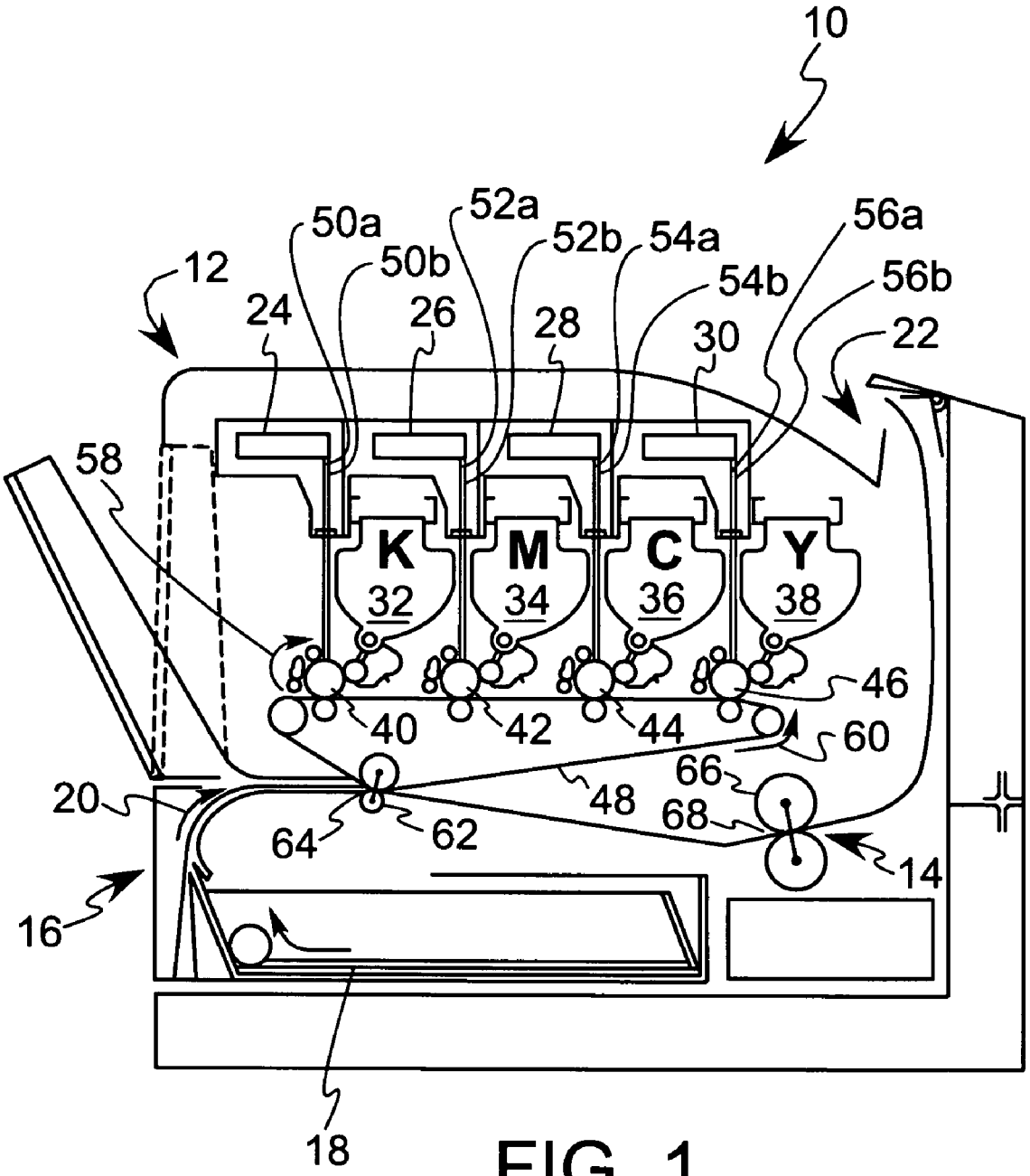
FIG. 1 is a side, schematic view of an exemplary electrophotographic imaging apparatus.

Referring now to the drawings, and particularly to FIG. 1, an electrophotographic device is illustrated in the form of a color laser printer 10. The printer 10 includes generally, an imaging section 12, a fusing section 14 and a paper path 16. Briefly, a sheet of print media 18 is transported along the paper path 16 in the direction of the arrow 20 so as to pass the imaging section 12. At the imaging section 12, cyan, yellow, magenta and black toner patterns (CYMK) are registered to form a color toner image, which is transferred to the print media 18. The print media 18 then passes through the fusing section 14, which causes the toner patterns to adhere to the print media 18. After fusing, the print media 18 is transported outside the printer 10 along the media discharge path 22.

To form the overlaid toner patterns, the imaging section 12 includes four printhead units 24, 26, 28, 30, four toner cartridges 32, 34, 36, 38, four photoconductive drums 40, 42, 44, 46 and an intermediate transfer belt 48. Printhead unit 24 generates two independently controllable laser beams 50*a*, 50*b* that are modulated in accordance with bitmap image data corresponding to the black color image plane to form a latent image on the photoconductive drum 40. Printhead unit 26 generates two independently controllable laser beams 52*a*, 52*b* that are modulated in accordance with bitmap image data corresponding to the magenta color image plane to form a latent image on the photoconductive drum 42. Printhead unit 28 generates two independently controllable laser beams 54*a*, 54*b* that are modulated in accordance with bitmap image data corresponding to the cyan color image plane to form a latent image on the photoconductive drum 44. Similarly, Printhead unit 30 generates two independently controllable laser beams 56*a*, 56*b* that are modulated in accordance with bitmap image data corresponding to the yellow color image plane to form a latent image on the photoconductive drum 46.

Each photoconductive drum 40, 42, 44, 46 continuously rotates clockwise (as shown) according to the directional arrow 58 past their associated toner cartridge 32, 34, 36, 38 such that toner is transferred to each photoconductive drum surface in a pattern corresponding to the latent image formed thereon. As the intermediate transfer belt 48 travels past each photoconductive drum 40, 42, 44, 46, as indicated by the directional arrow 60, the corresponding toner patterns are transferred to the outside surface of the intermediate transfer belt 48. The timing of the laser scanning operations on each of the photoconductive drums 40, 42, 44, 46, the speed of the intermediate transfer belt 48 and the timing of the travel of a print media 18 along the paper path 16 are coordinated such that a forward biased transfer roll 62 transfers the toner patterns from the belt 48 to the print media 18 at the nip 64 so as to form a composite color toner image on the print media 18.

The print media 18 is then passed through a fuser 66 at the fusing section 14. Generally, heat and pressure are applied to the print media 18 as it passes through a nip 68 of the fuser 66 so as to adhere the color toner image to the print media 18. The print media 18 is then discharged from the printer 10 along the media discharge path 22.

Figure 2:
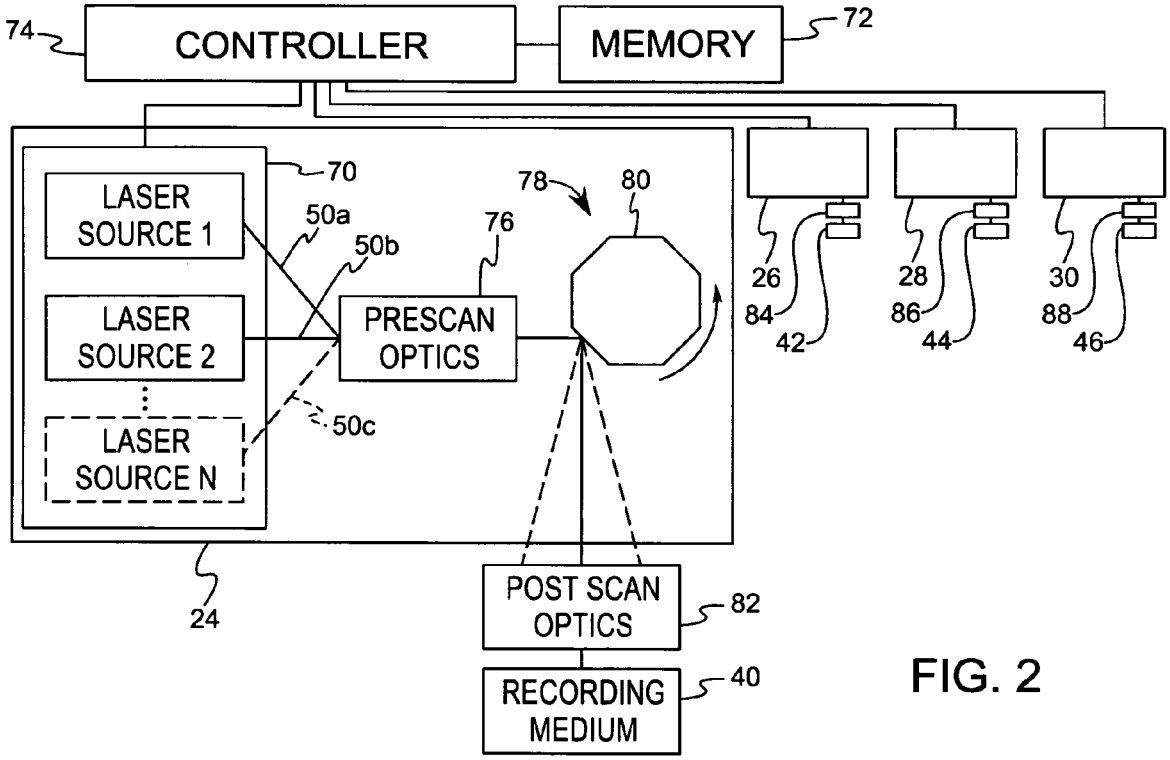
FIG. 2 is a schematic representation of a controller and a first printhead of the electrophotographic imaging apparatus of FIG. 1.

Referring now to FIG. 2, the printhead 24 includes a laser source 70, e.g., a pair of laser diodes, each laser diode generating an associated one of the laser beams 50*a*, 50*b*. For sake of clarity, the present invention will be generally described in terms of two laser beams per photoconductive surface. However, the present invention is expandable to any reasonable number 'N' of laser beams as indicated by the additional laser beam 50C in phantom lines. Moreover, the present invention can be practiced using a single laser beam. A controller 74, e.g., a video processor or other suitable control logic, converts image data stored in memory 72 into a format suitable for imaging by the printhead 24. The converted image data is communicated to the printhead 24. The controller 74 may further designate whether each laser beam 50*a*, 50*b* should be disabled or enabled to modulate image data for a particular print job as will be explained more fully herein. Each modulated laser beam 50*a*, 50*b* passes through pre-scan optics 76, and is reflected off of a rotating scanning device, e.g., a polygon mirror 78. The polygon mirror 78 includes a plurality of deflecting surfaces, e.g., facets 80 (eight facets as shown) that reflect the laser beams 50*a*, 50*b* through post scan optics 82 so as to sweep generally in a scan direction across the corresponding recording medium, e.g., the photoconductive drum 40. The printhead units 26, 28, 30 are similarly constructed and are thus not discussed in further detail.

Figure 3:
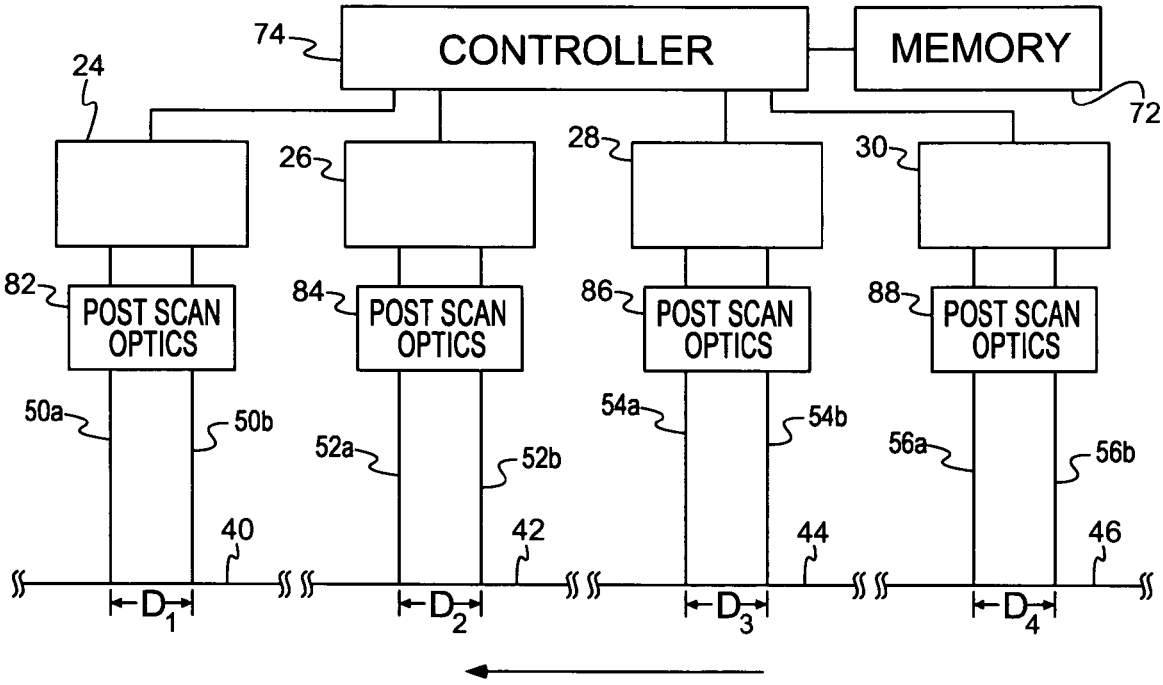
FIG. 3 is a schematic representation of the controller and four printheads of the electrophotographic imaging apparatus of FIGS. 1 and 2.

Referring to FIG. 3, the post scan optics 82 direct the laser beams 50*a*, 50*b* from the printhead unit 24 so as to form scan lines on the photoconductive drum 40. The scan lines are spaced from one another in the process direction, which is generally orthogonal to the scan direction, by a beam scan spacing D1. That is, in a given sweep in which each laser beam 50*a*, 50*b* is turned on or is otherwise modulated, the respective beams will be spaced from one another on the photoconductive surface in the process direction by the predetermined distance D1. This distance between beams defines a "beam scan spacing" for the beams 50*a*, 50*b* in the process direction.

Similarly, post-scan optics 84 direct the laser beams 52*a*, 52*b* emitted from the printhead unit 26 so as to form scan lines on the photoconductive drum 42, which are spaced from one another in the process direction by a beam scan spacing D2. Post-scan optics 86 direct the laser beams 54*a*, 54*b* emitted from printhead unit 28 so as to form scan lines on the photoconductive drum 44, which are spaced from one another in the process direction by a beam scan spacing D3. Similarly, post-scan optics 88 direct the laser beams 56*a*, 56*b* emitted from printhead unit 30 so as to form scan line lines are on the photoconductive drum 46, which are spaced from one another in the process direction by a beam scan spacing D4.

Multiple Speed Operation

In general, the image transfer rate of an electrophotographic device defines a speed in which a toner image is transferred from the photoconductive surface to an associated image transfer device. The image transfer device may comprise for example, the intermediate transfer belt 48 described with reference to FIG. 1, a transport belt that transports a print media directly past the photoconductive surface, or any other structure for transporting the print media or for transferring the toner patterns from the photoconductive surface to the print media. Additionally, the photoconductive surface is not limited to the photoconductive drums 40, 42, 44, 46 shown in FIG. 1, and may include for example, photoconductive belts or other structures.

Moreover, it is desirable in certain electrophotographic devices to provide two or more image transfer rates to support different modes of operation. Relatively slower image transfer rates generally result in the print media moving more slowly through the device, which may promote better fusing operations, e.g., to achieve translucence of color toners fused onto transparent media, or improve adherence of toner when printing thick, gloss or specialty papers. To this end, one approach is to slow down the image transfer rate by slowing down the intermediate transfer belt 48 and correspondingly slowing down the photoconductive drums 40, 42, 44, 46 and the associated transport of the print media 18. When slowing down the image transfer rate, either the laser output power, the rotational velocity of the polygon mirror, or both may be adjusted down in corresponding amounts to compensate for the new image transfer rate. However, a typical laser diode is not always adjustable to accommodate large variations in laser output power. For example, laser power adjustments over a wide range may result in spurious mode-hopping as the laser current approaches the laser power threshold for lasing. Moreover, the laser power must not exceed a specified maximum laser drive current level. Also, relatively large changes in laser power can affect the overall print quality due to changes in laser turn-on and turn-off timing. Relatively large variations in polygon motor velocity can also affect print quality, such as by causing jitter and otherwise unstable rotational velocity of the polygon mirror.

However, the speed of a brushless DC motor that is used to drive a photoconductive drum may be adjusted over a range of approximately 3:1 and still maintain a robust phase lock to maintain a relatively constant rotational velocity. As such, FIGS. 4-8 illustrate by way of illustration, and not by way of limitation, laser beam control for a printhead unit, e.g., the printhead unit 24 illustrated in FIG. 2, such that three exemplary speed modes can be realized, including full speed image transfer rate, i.e., maximum operational image transfer rate (FIG. 4), half speed image transfer rate (FIG. 5) and ⅓ speed image transfer rate (FIGS. 6-8).

For the discussion with reference to FIGS. 4-8, it is assumed that an electrophotographic device, e.g., the printer 10 described with reference to FIGS. 1-3, is calibrated so as to have a desired image characteristic. In the present example, the desired image characteristic is defined by an average and/or total exposure energy written to the photoconductive surface for a given image at a scanning resolution of 600 dpi (236 dots per centimeter) in the process direction at the full speed image transfer rate. As will be seen in greater detail below, for a given image, this desired image characteristic will remain generally consistent regardless of operation at the full speed image transfer rate, the one half speed image transfer rate, or the one third speed image transfer rate.

Further, it is assumed that the electrophotographic device has a "facet resolution" that is nominally 300 dpi (118 dots per centimeter) at the full speed image transfer rate. The term "facet resolution" is used herein to denote a maximum process direction resolution that may be realized by sweeping a single laser beam across the photoconductive surface based upon the current image transfer rate and rotational velocity of the polygon mirror. Thus, using only a single laser beam at the full speed image transfer rate, the facet resolution or maximum process direction resolution realizable is 300 dpi (118 dots per centimeter). Correspondingly, the term "facet spacing" denotes the process direction spacing of a select laser beam on the photoconductive surface as a result of adjacent facets of the polygon mirror intercepting and sweeping that laser beam. In this instance, the facet spacing is $1/300^{th}$ of an inch (84.6 microns). Without altering the rotational velocity of the polygon mirror, the facet spacing and corresponding facet resolution will change each time the image transfer rate changes because each is dependent, in part, upon the process direction speed of the photoconductive surface.

Still further, it is assumed that a printhead unit of the electrophotographic device, e.g., printhead unit 24, comprises two laser beams 50*a*-50*b* that are arranged so as to have a fixed nominal beam scan spacing D1 of $3/600^{th}$ inch (approximately 127 microns). In this instance, the beam scan spacing of $3/600^{th}$ inch (approximately 127 microns) is one and one half times the facet spacing of $1/300^{th}$ of an inch (84.6 microns). It is preferable to set the beam scan spacing to a distance that is not the same as the facet resolution, or an integer multiple thereof. Under such an arrangement, there will be a redundancy in beam scans between the laser beams. That is, because the beam scan spacing will align with the facet spacing, each laser beam 50*a*-50*b* will write a scan line along the same position on the photoconductive surface. However, the above-described redundancy may be avoided where the beam scan spacing is set to a distance less than the facet resolution, or the beam scan spacing may be set to a non-integer multiple of the facet resolution. As will be described in greater detail herein, one exemplary approach where there are two laser beams per photoconductive surface is to set the beam scan spacing to one half the facet spacing, or to any odd multiple of one half the facet spacing.

Figure 4:
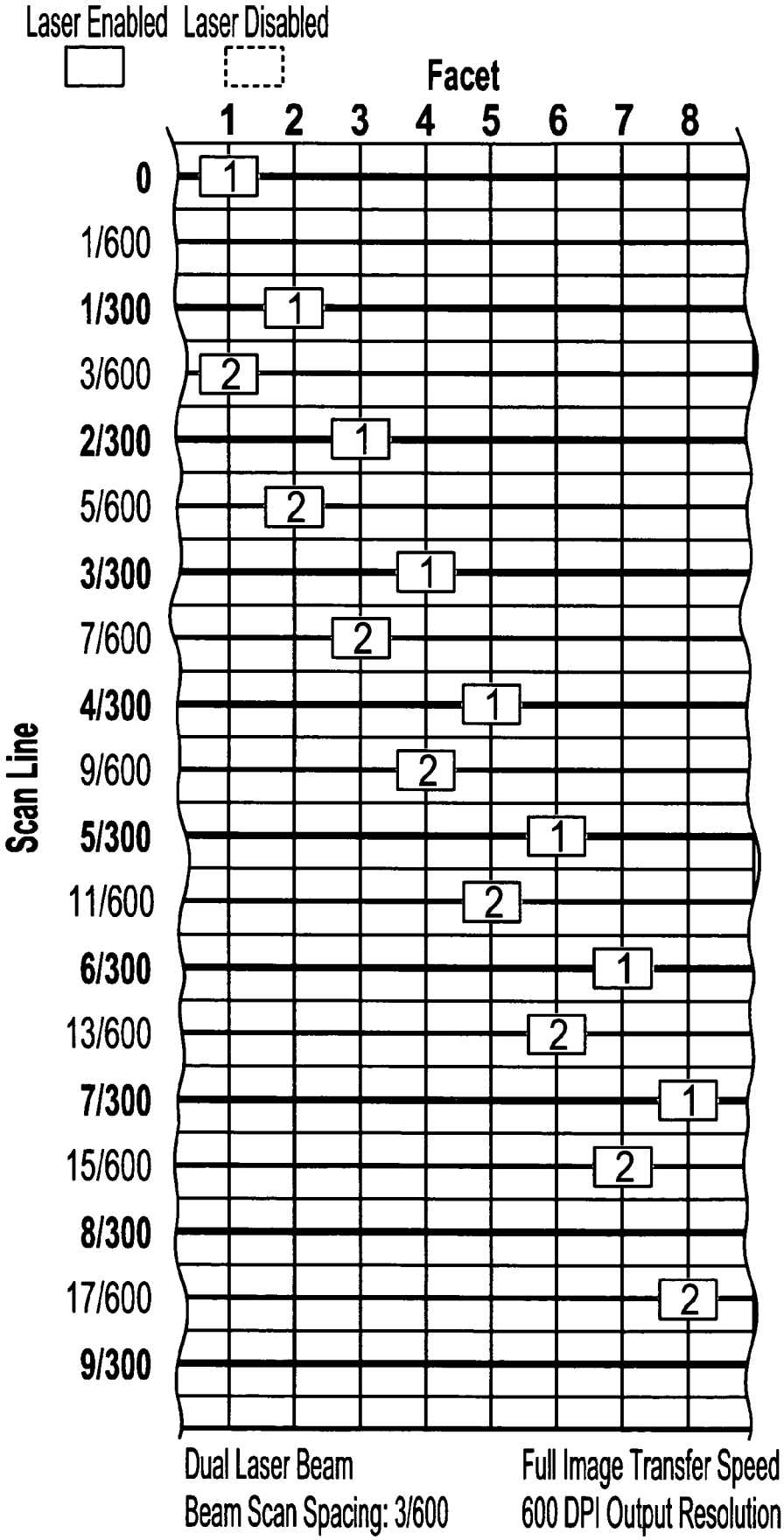
FIG. 4 is a diagram illustrating laser beam scan spacing for an exemplary dual laser printhead where the beam scan spacing is 3/600 inch (0.127 millimeters), the photoconductive surface is advancing at a full speed image transfer rate and the lasers are modulated so as to achieve a 600 dpi (236 dots per centimeter) effective scanning resolution.

With reference to FIG. 4, the columns in the illustrated chart are numbered 1 through 8 and correspond to facets of the polygon mirror 78, shown in FIG. 2, intercepting its two beams as the polygon mirror 78 rotates. As such, the chart of FIG. 4 represents one complete rotation of the polygon mirror 78, which has eight facets. The rows of the chart represent the process direction position of a laser scan on its corresponding photoconductive surface. As illustrated, the first laser beam, designated beam 1, is enabled so that it is modulated in accordance with image data on every facet of rotation of the polygon, and will thus scan across the photoconductive surface every $1/300^{th}$ of an inch (84.6 microns) in the process direction, corresponding to the facet resolution.

Similarly, the second beam, designated beam 2, is also enabled for each facet of the polygon rotation. As such, beam 2 will also be modulated in accordance with image data every $1/300^{th}$ of an inch (84.6 microns) in the process direction (corresponding to the facet resolution). However, because there is a $3/600^{th}$ of an inch (127 micron) spacing between laser 1 and laser 2, the modulated output of laser 2 will interlace with the modulated output of laser 1 and thus the effective scanning resolution is increased to 600 dpi (236 dots per centimeters) in the process direction. As can be seen by the chart, both laser 1 and laser 2 are modulated for each facet of rotation of the polygon mirror. Also, because the beam scan spacing ($3/600^{th}$ of an inch or 127 microns) is greater than the facet spacing ($1/300^{th}$ of an inch or 84.6 microns), there will be no scan line at $1/600^{th}$ of an inch (42.3 microns) from the first scan line. As such, the RIP processor will have to account for this, for example, by buffering the image data with two blank lines or by disabling the first laser beam for the first facet. Thus, on the first facet, the first laser beam may write no image data, and the second beam may write the second line of bitmap image data. Under this arrangement, at facet 2, the first laser beam writes the first line of bitmap image data, and the second laser writes the fourth line of bitmap image data. This process continues for each facet until the entire image is written.

Figure 5:
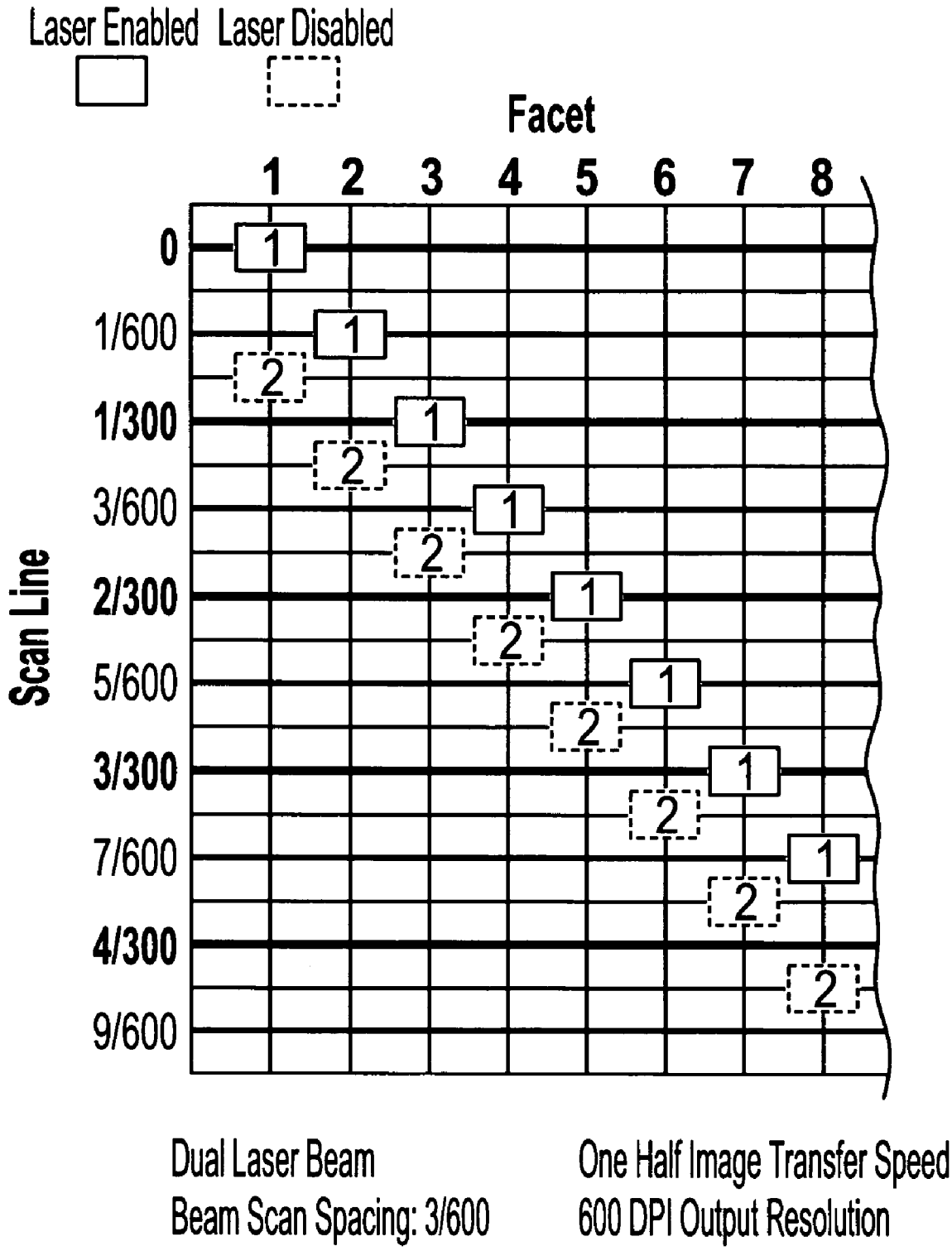
FIG. 5 is a diagram illustrating laser beam scan spacing for the dual laser printhead of FIG. 4, where the photoconductive surface is advancing at one half of the full image transfer rate and the lasers are modulated so as to achieve a 600 dpi (236 dots per centimeter) effective scanning resolution.
Figure 6:
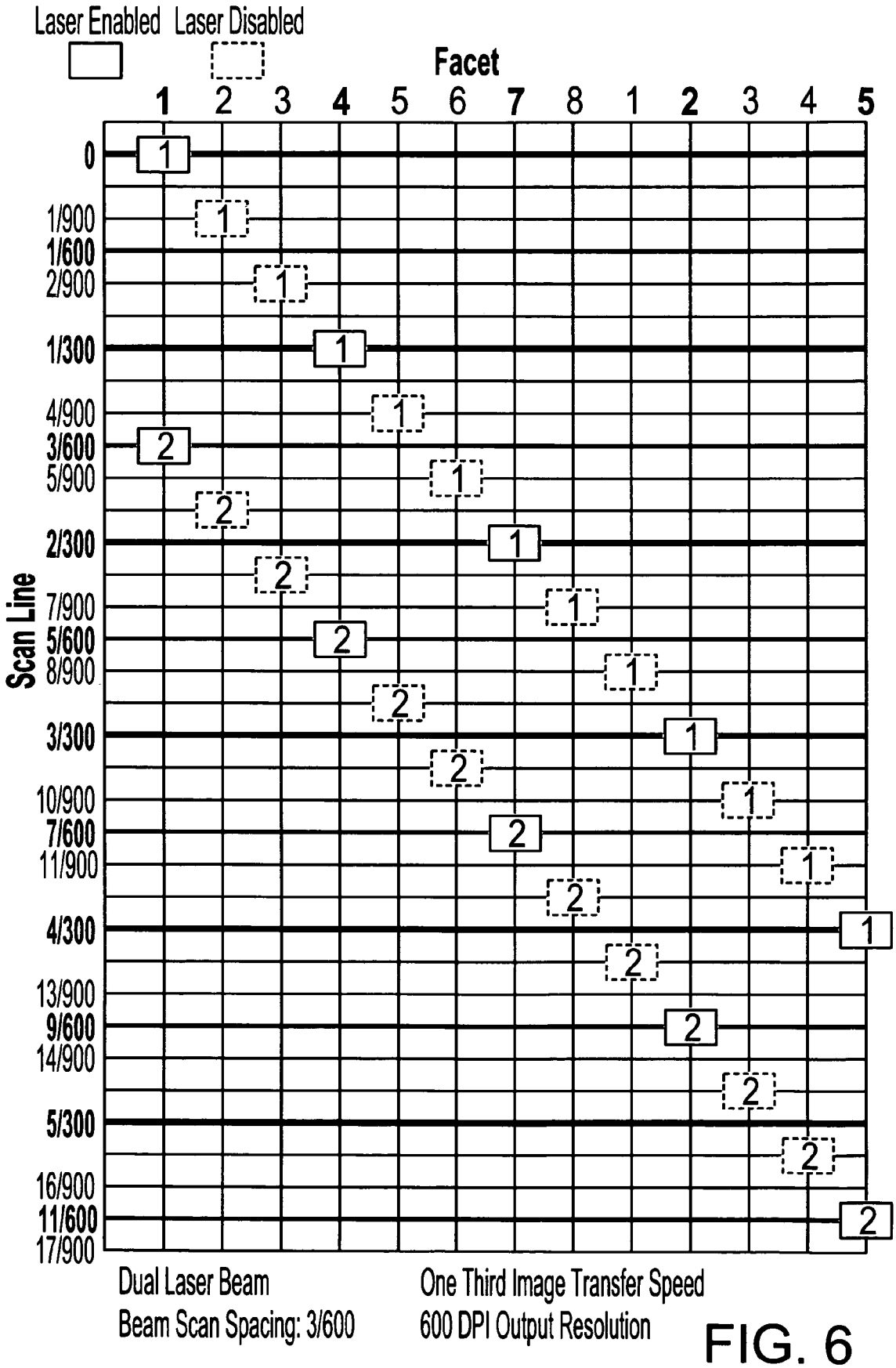
FIG. 6 is a diagram illustrating laser beam scan spacing for the dual laser printhead of FIG. 4, where the photoconductive surface is advancing at one third of the full image transfer rate and the lasers are modulated so as to achieve a 600 dpi (236 dots per centimeter) effective output resolution.

Referring to FIG. 5, if the image transfer rate is now reduced to one half of the full speed image transfer rate, such as by slowing down the photoconductive drum motor by an appropriate amount, and leaving all other parameters the same as the example of the full speed image transfer rate discussed with reference to FIG. 4, the effective process direction resolution is essentially double that of the process direction resolution when operating at the full speed image transfer rate. This is because the rotational velocity of the polygon mirror was not altered. However, the photoconductive surface is now moving in the process direction at half the speed that it was moving in the full image transfer rate example of FIG. 4. That is, each laser 50*a*-50*b* will scan the photoconductive surface at a facet resolution of 600 dpi (236 dots per centimeter) instead of a facet resolution of 300 dpi (118 dots per centimeter) as in the full speed image transfer rate example. However, note that by disabling or otherwise turning off a select one of the two lasers 50*a*-50*b*, e.g., by communicating the bitmap image data to only a select one of the lasers, the effective output resolution is still 600 dpi (236 dots per centimeter), corresponding to the desired image characteristic. Also, the image transfer rate was adjusted from a full speed to half speed without modification of the laser diode power output and without modification of the polygon motor velocity. Thus, the desired image characteristic is maintained because the total and average photoconductor exposure energy is nominally the same at both full and one half image transfer rates. Also, as noted in FIG. 5, every facet of the polygon mirror is utilized to scan the enabled laser (laser 1 as shown). That is, the photoconductive surface "sees" the same exposure energy and scan resolution at both the full speed and half speed image transfer rates. Also, it is noted that the beam scan spacing of $3/600^{th}$ of an inch (127 microns) did not change as a result of slowing down the image transfer rate.

The techniques herein may be implemented even where an image transfer rate is a reduced speed rate defined by a reduction of the full speed image transfer rate by a factor other than two, i.e., where the image transfer rate is set to a speed other than full speed or half speed. Referring to FIG. 6, if the image transfer rate is now reduced to one third of the full speed image transfer rate, such as by slowing down the photoconductive drum motor by an appropriate amount, and leaving all other parameters the same as the example of the full speed image transfer rate discussed with reference to FIG. 4, the effective process direction resolution is essentially triple that of the process direction resolution when operating at the full speed image transfer rate. This is because the rotational velocity of the polygon mirror was not altered. However, the photoconductive surface is now moving in the process direction at one third of the speed that it was moving in the full image transfer rate example of FIG. 4. Thus, each laser 50*a*-50*b* will scan the photoconductive surface at a facet resolution of 900 dpi (354 dots per centimeter) instead of the facet resolution of 300 dpi (118 dots per centimeter) in the full speed image transfer rate example.

Changing the image transfer rate from full speed to one third speed has no effect upon the beam scan spacing, which is fixed at a $3/600^{th}$ of an inch (127 micron) process direction spacing between laser beam 1 and laser beam 2. In this example, both laser beam 1 and laser beam 2 are enabled and scan the corresponding photoconductive surface in a repeating pattern that comprises both laser beam 1 and laser beam 2 enabled for a first facet, and disabled for the subsequent two facets. Thus, an effective output resolution of 600 dpi (236 dots per centimeter), is achieved. Notably, this one third output speed adjustment requires no modification of the laser diode output power and no adjustment of the polygon motor velocity. Further, because the laser power was not adjusted and the output resolution did not change, the average and total photoconductor exposure energy is nominally the same at both full and one third speeds. As such the desired image characteristic is once again met for the one third image transfer rate.

Also, because the beam scan spacing ($3/600^{th}$ of an inch or 127 microns) is greater than the facet spacing ($1/900^{th}$ of an inch or 28.2 microns), there will be no scan line at $1/600^{th}$ of an inch (42.3 microns). As such, the RIP processor will have to account for this, e.g., by buffering the image data with two blank scan lines by disabling the first laser beam for the first facet. Thus, on the first facet, the first laser beam will write no image data, and the second beam will write the second line of bitmap image data. At facets 2 and 3, both laser beams are off. At facet 4, the first laser beam writes the first line of bitmap image data, and the second laser writes the fourth line of bitmap image data. This process continues for each facet until the entire image is written.

The chart of FIG. 7 illustrates six complete revolutions of the polygon mirror for the one third speed mode also illustrated in FIG. 6. The chart of FIG. 7 shows one revolution of the polygon mirror in each column, and one facet of the polygon mirror is represented in each row. An "X" appearing in a cell of the chart indicates where the laser beams are enabled. For example, in the first complete rotation of the polygon mirror, facets 1, 4 and 7 are utilized to sweep the laser beams. In the second complete rotation of the polygon mirror, facets 2, 5 and 8 are utilized, and in the third complete rotation of the polygon mirror, facets 3 and 6 are utilized. As such, in three complete revolutions of the polygon mirror, each facet is utilized once. Thus every three complete rotations of the polygon mirror, each facet is used and no facet is used more than once in that range of three rotations. The above example assumes that there are eight facets on the polygon mirror, as shown in FIG. 2. The present invention is not limited to a particular number of facets or rotations per facet however.

Referring to FIG. 8, the data of FIG. 6 is presented in a different format to illustrate another aspect of the present invention. Using the techniques described more fully herein, a method for controlling an electrophotographic device for two or more image transfer rates is realized. As with the example of FIG. 4, initially, a desired image transfer rate is determined. In the present example, the desired image transfer rate is one-third the full speed image transfer rate. Based upon the desired image transfer rate and a predetermined polygon mirror rotational velocity, the facet resolution is determined. Knowing the beam scan spacing ($3/600^{th}$ of an inch or 127 microns in this example) and the facet resolution (900 dpi (354 dots per centimeter) in the process direction in this example), the process direction position of each laser beam 50*a*-50*b* can be determined for each facet of the polygon mirror for the entire image.

Each position thus defines a "candidate scan line" that the controller may opt to use or ignore. After identifying candidate scan lines for each laser beam 50*a*-50*b* for each facet of the polygon mirror, the controller may perform scan line selection to achieve the desired image characteristic. For example, the controller may select scan lines from the available candidate scan line positions based upon a predetermined or desired output resolution. Candidate scan lines may thus identify for a given image transfer rate, the relative process direction position of each laser beam for each facet of scanning by the polygon mirror. From the possible candidate scan lines, select scan lines are identified based upon the desired image characteristic. This essentially tells the controller which laser beams to enable for each facet of the polygon mirror to achieve the desired image characteristic when printing an image.

In the current example, the desired image characteristic defines a total exposure energy when the laser scanning rate in the process direction is 600 dpi. Conveniently, there are candidate scan lines that fall on $1/600^{th}$ of an inch (42.3 micron) increments as indicated by the bolded position indications at $1/600^{th}$ of in inch (42.3 micron) increments. Also, the "X" appearing in the "600 DPI" column indicates that a candidate scan line has been selected and the remainder of the facet/laser beam positions can be ignored, such as by disabling or not writing to the corresponding laser beam to skip the associated facet. The present invention can be expanded for any reasonable number of laser beams and any reasonable number of facets of the polygon mirror. Thus, the controller determines which laser beam or beams to modulate with image data, and which facet or pattern of facets to utilize for laser scanning for each facet of rotation based upon the selected candidate scan lines.

As demonstrated above, the present technique works even when the process direction spacing between adjacent candidate scan lines for a first one of the image transfer rates, e.g., the full speed image transfer rate, is an amount other than double the process direction spacing between adjacent candidate scan lines for a second one of the image transfer rates, e.g., the one third speed image transfer rate. For example, for the full speed image transfer rate illustrated in FIG. 4, the process direction spacing between candidate scan lines is $1/600^{th}$ of an inch (42.3 micron). At the half speed image transfer rate described with reference to FIG. 5, the image transfer rate is slowed to half speed and the velocity of the polygon mirror is unchanged. As such, the spacing between candidate scan lines is $1/1200^{th}$ of an inch (21.15 micron). Thus, the process direction spacing of candidate scan lines for the full speed image transfer rate is double the process direction spacing of candidate scan lines for this particular half speed image transfer rate example. However, for the one third speed image transfer rate example discussed with reference to FIG. 6, the image transfer rate is slowed to one third of the full speed image transfer rate and the rotational velocity of the polygon mirror is unchanged. As such, the process direction spacing between candidate scan lines for the one-third speed example is $1/1800^{th}$ of an inch (14.1 micron). The process direction spacing between adjacent candidate scan lines for the full speed image transfer rate is thus an amount other than double the process direction spacing between adjacent candidate scan lines for the one third speed image transfer rate.

Depending upon how the candidate scan lines are selected, some modification may be required to the laser beam output power to achieve the desired image characteristic. Keeping with the one third speed image transfer rate example of FIGS. 6-8, it can be seen that an alternative way to select from the candidate scan lines over that illustrated in FIG. 8 is to enable a select one of laser beam 1 or laser beam 2 for every facet of rotation of the polygon mirror. As seen in the chart of FIG. 8 in the column labeled "900 DPI", selecting candidate scan lines defined by a single laser for each facet of rotation of the polygon mirror will result in an effective scan resolution of 900 dpi (354 dots per centimeter), and not the desired 600 dpi (236 dots per centimeters).

However, by modulating only one laser beam at 900 dpi (354 dots per centimeter), and by reducing the laser power output of that laser beam for each scan to two thirds of the laser output power utilized for full speed mode printing, e.g., by reducing the laser diode drive current to an appropriate level, the total photoconductor exposure energy is nominally the same at both the full speed image transfer rate and one third speed image transfer rate. Thus, the desired image characteristic is maintained. That is, the total exposure energy of the photoconductive surface when writing an image at 600 dpi (236 dots per centimeters) using both laser beams, where the laser power of each beam is set to the level typically used when operating at the full speed image transfer rate, is the same as the total exposure energy of that same photoconductive surface when scanning a single laser beam at 900 dpi (354 dots per centimeter) where the laser beam power is two thirds the laser power at the full image transfer rate.

Similarly, the average exposure energies of the photoconductive surface, e.g., in each 300×300 dpi square, is the same at the full speed image transfer rate and one third image transfer rate where a single beam scans at 900 dpi (354 dots per centimeter) at ⅔ the laser power. This example assumes that the laser output power can be adjusted down to two thirds the output power utilized for the full speed image transfer rate. The one third image transfer rate is achieved without requiring pulse width modulation of the laser power to achieve the desired photoconductor exposure energy. Still further, if there are no candidate scan lines that enable the desired resolution, the polygon mirror velocity can be adjusted to modify the facet resolution. Under this arrangement, the above method is repeated for the new facet resolution.

The above examples discussed with reference to FIGS. 4-8 assume that the beam scan spacing of a dual laser diode printhead unit is greater than the facet resolution. However, the techniques described with reference thereto are equally applicable where the beam scan spacing is less than the facet resolution. For example, assume that the printer 10 described with respect to FIGS. 1-3 is calibrated such that the facet resolution is 600 dpi at the full speed image transfer rate, and that a printhead, e.g., the printhead 24 comprises two corresponding laser beams 50*a*-50*b*, each arranged so as to have a beam scan spacing of $1/1200^{th}$ of an inch (21 microns). The beam scan spacing is now one half of the facet resolution. For the discussion with reference to FIGS. 9-13, it is further assumed that an electrophotographic device, e.g., the printer 10 described with reference to FIGS. 1-3 is calibrated so as to have a desired image characteristic, which is defined in this example to require a predetermined average and/or total exposure energy written to the photoconductive surface at a scanning resolution of 1200 dpi (472 dots per centimeter) in the process direction at the full speed image transfer rate. This desired image characteristic further requires that the average and/or total exposure energy remain generally consistent regardless of operation at the full speed image transfer rate, the one half speed image transfer rate, or the one third speed image transfer rate.

Figure 9:
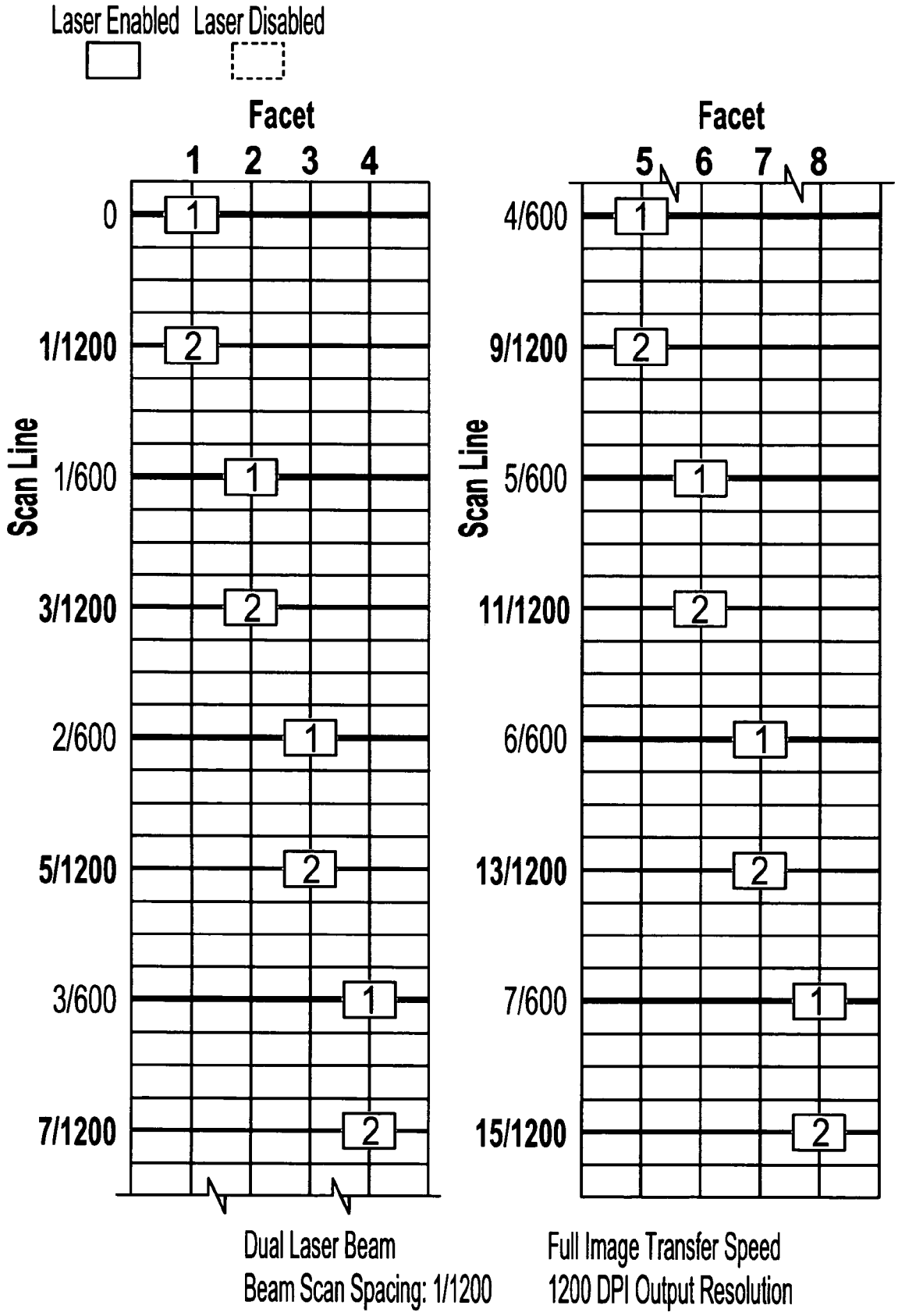
FIG. 9 is a diagram illustrating laser beam scan spacing for an exemplary dual laser printhead where the beam scan spacing is 1/1200 (0.0212 millimeters), the photoconductive surface is advancing at a full speed image transfer rate and the lasers are modulated so as to achieve a 1200 dpi (472 dots per centimeter) effective scanning resolution.

With reference to FIG. 9, the columns in the illustrated chart are numbered 1 through 8 and correspond to facets of a polygon mirror 78 intercepting its two beams as the polygon mirror 78 rotates. As such, the chart of FIG. 9 represents one rotation of the polygon mirror 78 shown in FIG. 2, which has eight facets. The rows of the chart represent the process direction position of a laser scan on its corresponding photoconductive surface. As illustrated, the first laser beam, designated beam 1, is enabled so that it is modulated in accordance with image data on every facet of rotation of the polygon, and will thus scan across the photoconductive surface every $1/600^{th}$ of an inch (42.3 microns) in the process direction, corresponding to the facet resolution.

Similarly, the second beam, designated beam 2, is also enabled for each facet of the polygon rotation. As such, beam 2 will also be modulated in accordance with image data every $1/600^{th}$ of an inch (42.3 microns) in the process direction (corresponding to the facet resolution). However, because there is a $1/1200$th of an inch (21 micron) spacing between laser 1 and laser 2, the modulated output of laser 2 will interlace with the modulated output of laser 1 and thus the effective scanning resolution is increased to 1200 dpi (472 dots per centimeter) in the process direction. As can be seen by the chart, both laser 1 and laser 2 are modulated for each facet of rotation of the polygon mirror. Also, because the beam scan spacing ($1/1200^{th}$ of an inch or 21 microns) is less than the facet spacing ($1/600^{th}$ of an inch or 42.3 microns), imaging can begin on the first encountered facet using both laser beams and there will be no need to skip the first facet with laser 1 as in the example described with reference to FIG. 4.

Figure 10:
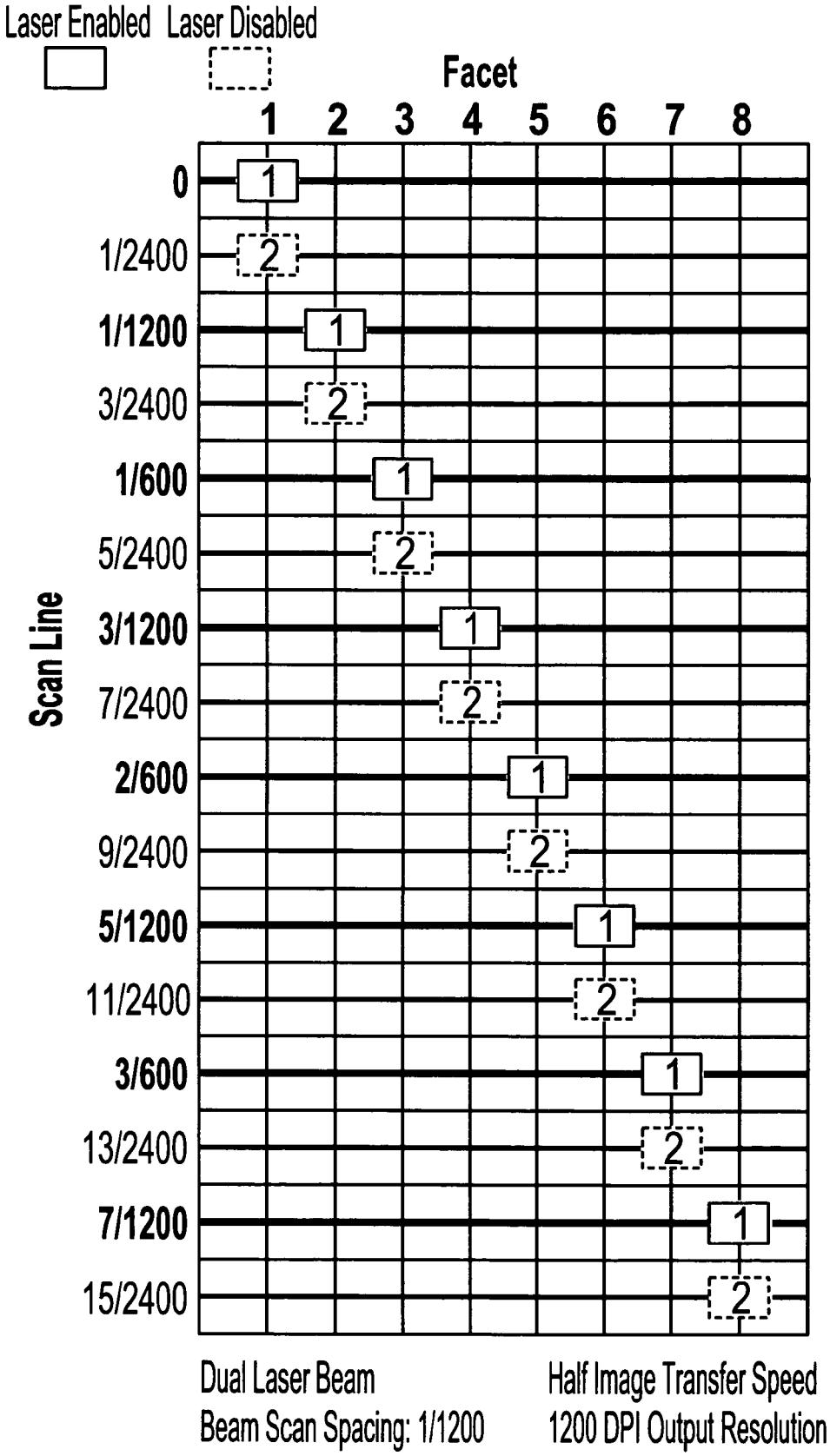
FIG. 10 is a diagram illustrating laser beam scan spacing for the dual laser printhead of FIG. 9, where the photoconductive surface is advancing at one half of the full speed rate and the lasers are modulated so as to achieve a 1200 dpi (472 dots per centimeter) effective scanning resolution.
Figure 11:
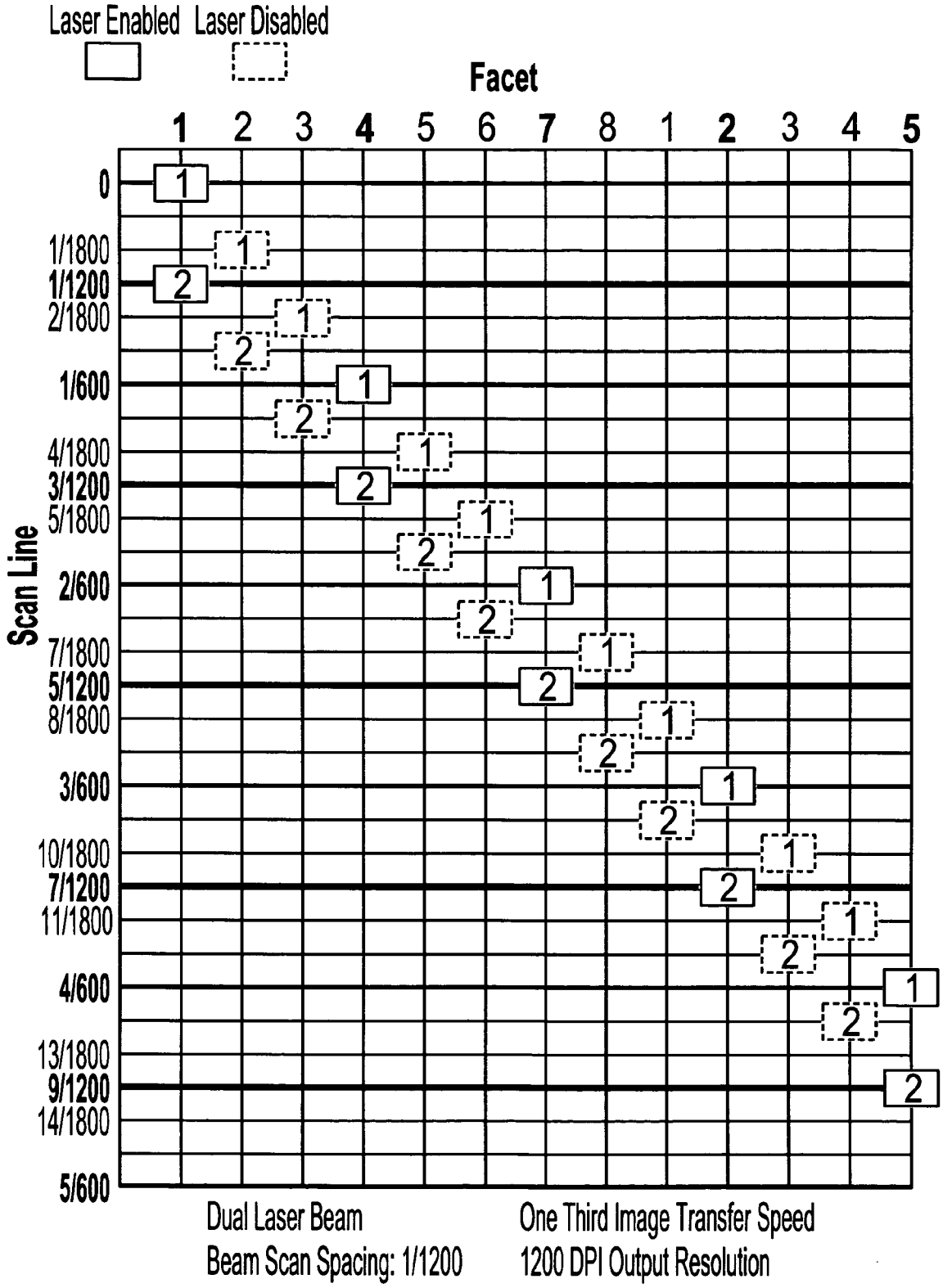
FIG. 11 is a diagram illustrating laser beam scan spacing for the dual laser printhead of FIG. 9, where the photoconductive surface is advancing at one third of the full speed rate and the lasers are modulated so as to achieve a 1200 dpi (472 dots per centimeter) effective scanning resolution.

Referring to FIG. 10, if the image transfer rate is now reduced to one half of the full speed image transfer rate, such as by slowing down the photoconductive drum motor by an appropriate amount, and leaving all other parameters the same as the example of the full speed image transfer rate discussed with reference to FIG. 9, the effective process direction resolution is essentially double that of the process direction resolution when operating at the full speed image transfer rate. This is because the rotational velocity of the polygon mirror was not altered. However, the photoconductive surface is now moving in the process direction at half the speed that it was moving in the full image transfer rate example of FIG. 9. That is, each laser 50*a*-50*b* will scan the photoconductive surface at a facet resolution of 1200 dpi (472 dots per centimeter) instead of a facet resolution of 600 dpi (236 dots per centimeter) as in the full speed image transfer rate example. However, note that by disabling or otherwise turning off a select one of the two lasers 50*a*-50*b*, e.g., by communicating the bitmap image data to only a select one of the lasers, the effective output resolution is still 1200 dpi (472 dots per centimeter), corresponding to the desired image characteristic.

Also, the image transfer rate was adjusted from a full speed to half speed without modification of the laser diode power output and without modification of the polygon motor velocity. Thus, the desired image characteristic is further met because the total and average photoconductor exposure energy is nominally the same at both full and one half image transfer rates. Also, as noted in FIG. 10, every facet of the polygon mirror is utilized to scan the enabled laser (laser 1 as shown).

Referring to FIG. 1, if the image transfer rate is now reduced to one third of the full speed image transfer rate, such as by slowing down the photoconductive drum motor by an appropriate amount, and leaving all other parameters the same as the example of the full speed image transfer rate discussed with reference to FIG. 9, the effective process direction resolution is essentially triple that of the process direction resolution when operating at the full speed image transfer rate. This is because the rotational velocity of the polygon mirror was not altered. However, the photoconductive surface is now moving in the process direction at one third of the speed that it was moving in the full image transfer rate example of FIG. 9. That is, each laser 50*a*-50*b* will scan the photoconductive surface at a facet resolution of 1800 dpi (709 dots per centimeter) instead of the facet resolution of 600 dpi (236 dots per centimeter) in the full speed image transfer rate example.

Changing the image transfer rate from full speed to one third speed has no effect upon the beam scan spacing, which is fixed at a 1/1200th of an inch (21 micron) process direction spacing between laser beam 1 and laser beam 2. In this example, both laser beam 1 and laser beam 2 are enabled and scan the corresponding photoconductive surface in a repeating pattern that comprises both laser beam 1 and laser beam 2 enabled for a first facet, and disabled for the subsequent two facets. Thus, an effective output resolution of 1200 dpi (472 dots per centimeter) is achieved. Notably, this one-third output speed adjustment requires no modification of the laser diode output power and no adjustment of the polygon motor velocity. Further, because the laser power was not adjusted and the output resolution did not change, the average and total photoconductor exposure energy is nominally the same at both full and one-third speeds. As such the desired image characteristic is once again met for the one-third image transfer rate. Also, it can be seen from the chart of FIG. 11 that the lines of bitmap image data are interleaved when writing using both laser beams. The first bitmap image line is written by the first laser beam on the first facet sweep. The second line of bitmap image data is written by the second laser beam, again on the first facet sweep. Both the first and second laser beams are disabled for facets 2 and 3, and the third line of bitmap image data is written by the first laser beam on the fourth facet sweep. Correspondingly, the fourth line of bitmap image data is written by the second laser beam on the fourth facet sweep. This process continues for each facet until the entire image is written.

With reference to FIG. 12, in the first complete rotation of the polygon mirror, facets 1, 4 and 7 are utilized to sweep the laser beams. In the second complete rotation of the polygon mirror, facets 2, 5 and 8 are utilized, and in the third complete rotation of the polygon mirror, facets 3 and 6 are utilized. As such, in three complete revolutions of the polygon mirror, each facet is utilized once. Thus every three complete rotations of the polygon mirror, each facet is used and no facet is used more than once. The above example again assumes that there are eight facets on the polygon mirror, as shown in FIG. 2.

With reference to FIG. 13, the method of the present invention, which was described in greater detail with reference to FIG. 7, is illustrated for the case where the beam scan spacing is less than the facet resolution. Initially, the desired image transfer rate is selected, one third of the full speed image transfer rate in this example. A desired image characteristic is identified, which in this example is a total or average exposure energy when the process direction scanning rate is 1200 dpi in the process direction at the full image transfer rate. With the facet resolution known, e.g., by setting the rotational velocity of the polygon mirror to a known rotational speed, and with the desired image characteristic identified, candidate scan lines are determined, e.g., for each laser beam and for each facet. From the identified candidate scan lines, select ones of the scan lines are selected to achieve the desired image characteristic. In the present example, candidate scan lines are available at the desired output resolution of 1200 dpi so no modification to the rotational velocity of the polygon mirror or laser power output is required.

As with the example of FIG. 6, an alternative to using both laser beams on every third facet is to use a select one of the first or second beam, and reduce the laser power of that beam to two thirds the laser output power used in the full speed mode. Under this arrangement, the nominal exposure energy of the photoconductive surface is the same as the full speed mode of operation in a manner analogous to that described in greater detail with reference to FIG. 8.

Although the above examples demonstrate two laser beams per photoconductive surface for convenience of discussion, the present invention may be applied to systems comprising one or more laser beams in practice. As an example, assume that only a single laser beam is provided for writing a latent image to a photoconductive surface, and that the full speed image transfer rate is 25 pages per minute at 600 dpi (236 dots per centimeter), which is also the facet resolution. Further assume that an image transfer rate of 10 pages per minute is desired. Using the techniques set out more fully herein, it can be seen that the 10 pages per minute image transfer rate may be obtained by slowing down the photoconductive drum motor by an appropriate amount. However, leaving all other parameters unchanged, the effective process direction resolution is now 1500 dpi (591 dots per centimeter) because the photoconductive surface is now moving at 40 percent of the speed it was moving at the full speed image transfer rate of 25 pages per minute. Note however, that by increasing the velocity of the polygon mirror by 20%, i.e., by a factor of $^{30}/_{25}{}^{ths}$, the effective process direction resolution increases to 1800 dpi (709 dots per centimeter).

The above can be conceptualized as a set of candidate scan lines at a spacing of 1800 dpi (709 dots per centimeter). Thus, a desired image transfer characteristic, e.g., an output resolution is achieved by selecting scan lines from the available candidate scan line positions. In the present example, a desired 600 dpi (236 dots per centimeter) output is achieved by skipping two facets for every facet utilized in a manner analogous to that described with reference to FIGS. 6-8 and 11-13. Note that in this example, an additional image transfer characteristic such as a total exposure energy is achieved by increasing the laser power by a factor of $^{30}/_{25}{}^{ths}$.

Having described the invention in detail and by reference to preferred embodiments thereof, it will be apparent that modifications and variations are possible without departing from the scope of the invention defined in the appended claims.

What is claimed is:

1. An electrophotographic device comprising:

at least two laser sources, each laser source independently controllable to emit a laser beam;

a photoconductive surface operable at two or more image transfer rates;

a scanning device having a plurality of deflecting surfaces, said scanning device arranged to direct said laser beams so as to sweep in a scan direction across said photoconductive surface such that, for each sweep, scan lines written by said laser beams are spaced from one another on said photoconductive surface in a process direction that is nominally orthogonal to said scan direction by a predetermined beam scan spacing; and a controller arranged to maintain a desired image characteristic independent of a selected one of said image transfer rates by controlling said laser beams so as to write image data only at select scan lines that have been identified from candidate scan lines wherein:

said image characteristic comprises at least one of a total or average exposure energy of said photoconductive surface for a given image;

a rotational velocity of said scanning device is set to a predetermined rotational velocity based upon said selected one of said image transfer rates;

said candidate scan lines are defined by positions along said photoconductive surface that are determined at least in part, by one or more of: said selected one of said image transfer rates, said predetermined rotational velocity of said scanning device, the number of independently controllable laser beams that may be swept across said photosensitive surface and their corresponding beam scan spacing; and a process direction spacing between adjacent candidate scan lines for a first one of said image transfer rates is an amount other than double the process direction spacing between adjacent candidate scan lines for a second one of said image transfer rates.

2. The electrophotographic device according to claim 1, wherein said image characteristic further comprises a predetermined process direction resolution.

3. The electrophotographic device according to claim 1, wherein each deflecting surface of said scanning device is used to scan at least one of said laser beams to form an image on said photoconductive surface at each of said at least two image transfer rates.

4. The electrophotographic device according to claim 1, wherein said predetermined beam scan spacing is fixed at a distance defined to be nominally one half of a scan resolution or an odd multiple thereof, wherein said scan resolution is defined as a process resolution of a single beam at a full speed image transfer rate.

5. The electrophotographic device according to claim 1, wherein at least one of said predetermined rotational velocity of said scanning device or a laser power of said laser beams is altered when switching between said first one and said second one of said image transfer rates.

6. The electrophotographic device according to claim 1, wherein said predetermined rotational velocity of said scanning device is not altered when switching between said first one and said second one of said image transfer rates.

7. The electrophotographic device according to claim 1, wherein:

said at least two independently controllable laser beams comprise exactly two independently controllable laser beams;

said first one of said image transfer rates defines a full speed image transfer rate;

both of said laser beams are enabled to write to said photoconductive surface and each deflecting surface of said scanning device is utilized in sequence at said first one of said image transfer rates;

said second one of said image transfer rates defines an image transfer rate that is reduced from said full speed image transfer rate; and both of said laser beams are enabled to write to said photoconductive surface in a pattern that writes to a first deflecting surface of said scanning device and skips the next one or more deflecting surfaces of said scanning device in a pattern such that each deflecting surface is utilized at least once at said second one of said image transfer rates.

8. The electrophotographic device according to claim 1, wherein deflecting surfaces of said scanning device are selectively skipped when printing at one or more of said image transfer rates such that after a predetermined number of revolutions of said scanning device, each deflecting surface is utilized at least once.

9. The electrophotographic device according to claim 1, wherein:

said at least two independently controllable laser beams comprise exactly two independently controllable laser beams, said first one of said image transfer rates defines a full speed image transfer rate;

both of said laser beams are enabled to write to said photoconductive surface and each deflecting surface of said scanning device is utilized in sequence at said full speed image transfer rate; and said second one of said image transfer rates defines an image transfer rate that is reduced from said full speed image transfer rate, wherein:

a select one of said two laser beams is disabled;

the remainder one of said two laser beams is enabled to write a scan line for each deflecting surface of said scanning device; and a laser output power of said remainder one of said two laser beams is adjusted such that a total exposure energy of said photoconductive surface for a given image is nominally the same for said full speed mode and said reduced speed mode.

10. An electrophotographic device comprising:

a laser source having at least one independently controllable laser beam;

a photoconductive surface operable at two or more image transfer rates;

a scanning device having a plurality of deflecting surfaces, said scanning device arranged to direct said at least one laser beam so as to sweep in a scan direction across said photoconductive surface; and a controller arranged to maintain a desired image characteristic independent of a selected one of said image transfer rates by controlling said laser beams so as to write image data only at select scan lines that have been identified from candidate scan lines wherein:

each deflecting surface of said scanning device is used to scan at least one laser beam to form an image on said photoconductive surface at each of said at least two image transfer rates;

a rotational velocity of said scanning device is set to a predetermined rotational velocity based upon said selected one of said image transfer rates;

said candidate scan lines are defined by positions along said photoconductive surface that are determined at least by one or more of said selected one of said image transfer rates and said predetermined rotational velocity of said scanning device; and a process direction spacing between adjacent candidate scan lines for a first one of said image transfer rates is an amount other than double the process direction spacing between adjacent candidate scan lines for a second one of said image transfer rates.

11. The electrophotographic device according to claim 10, wherein:

said controller further performs at least one of an adjustment to said rotational velocity of said scanning device or an adjustment of laser beam output power based upon said selected one of said image transfer rates; and said candidate scan lines are determined based upon said at least one adjustment.

12. The electrophotographic device according to claim 10, wherein said image characteristic comprises a predetermined process direction resolution.

13. The electrophotographic device according to claim 10, wherein said image characteristic comprises at least one of a total or average exposure energy of said photoconductive surface for a given image.

14. An electrophotographic device comprising:

a laser source having at least one independently controllable laser beam;

a photoconductive surface operable at two or more image transfer rates, wherein a first one of said image transfer rates is defined by a full speed image transfer rate, and a second one of said image transfer rates is a reduced speed rate defined by a reduction of said full speed image transfer rate by a factor other than two;

a scanning device having a plurality of deflecting surfaces, said scanning device arranged to direct said at least one laser beam so as to sweep in a scan direction across said photoconductive surface; and a controller arranged to maintain a desired image characteristic on said photoconductive surface for a given image independent of a selected one of said image transfer rates by controlling said laser source so as to write image data only at select scan lines that have been identified from candidate scan lines, wherein said image characteristic comprises at least one of a total or average exposure energy of said photoconductive surface for a given image;

wherein said candidate scan lines are defined by positions of said photoconductive surface that are determined in part, by one or more of: said selected one of said image transfer rates, a rotational velocity of said scanning device, and the number of independently controllable laser beams that may be swept across said photosensitive surface.

15. The electrophotographic device according to claim 14, wherein said image characteristic further comprises a predetermined process direction resolution.

16. The electrophotographic device according to claim 14, wherein:

said controller further performs at least one of an adjustment to said rotational velocity of said scanning device or an adjustment of laser beam output power based upon said selected one of said image transfer rates; and said candidate scan lines are determined based upon said at least one adjustment.

17. A method of providing multiple image transfer rates in an electrophotographic device comprising:

providing a laser source configured to emit at least one independently controllable laser beam;

providing a scanning device having a plurality of deflecting surfaces, said scanning device arranged to direct said at least one laser beam so as to sweep in a scan direction across a photoconductive surface so as to write a latent image thereon, operating said photoconductive surface at a select one of at least two image transfer rates, wherein a first one of said image transfer rates is defined by a full speed image transfer rate, and a second one of said image transfer rates is a reduced speed rate defined by a reduction of said full speed image transfer rate by a factor other than two;

identifying a candidate scan line for laser beams and deflecting surfaces of said scanning device based upon said select one of said image transfer rates;

identifying a relative position in the process direction of each candidate scan line;

identifying a desired image characteristic, wherein said desired image characteristic comprises defining a or average total photoconductive exposure energy to be nominally the same for a given toner image regardless of said image transfer rate;

identifying select ones of said candidate scan lines based upon said desired image characteristic; and operating said laser source so as to write image data to said photoconductive surface at said select ones of said candidate scan lines to achieve an output image corresponding to said desired image characteristic such that each deflecting surface of said rotating scanning device is utilized to scan said photoconductive surface.

18. The method according to claim 17, wherein:

said laser source comprises two laser beams, said laser beams being spaced on said photoconductive surface by a fixed beam scan spacing; and further comprising:

identifying a relative position in the process direction of each candidate scan line is further based upon said beam scan spacing.

19. The method according to claim 17, further comprising:

setting said beam scan spacing to a distance of nominally one half of a scan resolution or an odd multiple thereof, wherein said scan resolution is defined as a process resolution of a single beam at said full speed image transfer rate.

20. The method according to claim 17, wherein said desired image transfer characteristic further comprises defining a desired process direction output resolution to be nominally the same for a given toner image regardless of said image transfer rate.

21. A method of providing multiple image transfer rates in an electrophotographic device comprising:

providing a laser source configured to emit at least one independently controllable laser beam;

providing a scanning device having a plurality of deflecting surfaces, said scanning device arranged to direct said at least one laser beam so as to sweep in a scan direction across a photoconductive surface so as to write a latent image thereon, operating said photoconductive surface at a select one of at least two image transfer rates, wherein a first one of said image transfer rates is defined by a full speed image transfer rate, and a second one of said image transfer rates is a reduced speed rate defined by a reduction of said full speed image transfer rate by a factor other than two;

identifying a candidate scan line for laser beams and deflecting surfaces of said scanning device based upon said select one of said image transfer rates;

identifying a relative position in the process direction of each candidate scan line;

identifying a desired image characteristic, identifying select ones of said candidate scan lines based upon said desired image characteristic; and operating said laser source so as to write image data to said photoconductive surface at said select ones of said candidate scan lines to achieve an output image corresponding to said desired image characteristic such that each deflecting surface of said rotating scanning device is utilized to scan said photoconductive surface;

further comprising selectively skipping deflecting surfaces of said scanning device such that after a predetermined number of revolutions of said scanning device, each deflecting surface is utilized at least once.

22. The method according to claim 17, wherein a first one of said image transfer rates is defined by a full speed image transfer rate, and a second one of said image transfer rates is a reduced speed rate defined by a reduction of said full speed image transfer rate by a non-even integer factor.

23. The electrophotographic device according to claim 10, wherein:

said laser source comprises at least two independently controllable laser beams; and deflecting surfaces of said scanning device are selectively skipped when printing at one or more of said image transfer rates such that after a predetermined number of revolutions of said scanning device, each deflecting surface is utilized at least once.

24. The electrophotographic device according to claim 10, wherein:

said laser source comprises at least two independently controllable laser beams;

said first one of said image transfer rates defines a full speed image transfer rate;

both of said laser beams are enabled to write to said photoconductive surface and each deflecting surface of said scanning device is utilized in sequence at said first one of said image transfer rates;

said second one of said image transfer rates defines an image transfer rate that is reduced from said full speed image transfer rate; and both of said laser beams are enabled to write to said photoconductive surface in a pattern that writes to a first deflecting surface of said scanning device and skips the next one or more deflecting surfaces of said scanning device in a pattern such that each deflecting surface is utilized at least once at said second one of said image transfer rates.

25. The electrophotographic device according to claim 10, wherein:

said laser source comprises at least two independently controllable laser beams;

said first one of said image transfer rates defines a full speed image transfer rate;

both of said laser beams are enabled to write to said photoconductive surface and each deflecting surface of said scanning device is utilized in sequence at said full speed image transfer rate; and said second one of said image transfer rates defines an image transfer rate that is reduced from said full speed image transfer rate, wherein:

a select one of said two laser beams is disabled;

the remainder one of said two laser beams is enabled to write a scan line for each deflecting surface of said scanning device; and a laser output power of said remainder one of said two laser beams is adjusted such that a total exposure energy of said photoconductive surface for a given image is nominally the same for said full speed mode and said reduced speed mode.

26. The method according to claim 21, wherein said identifying a desired image characteristic comprises at least one of:

defining a desired process direction output resolution to be nominally the same for a given toner image regardless of said image transfer rate;

defining a total photoconductive exposure energy to be nominally the same for a given toner image regardless of said image transfer rate; and defining an average photoconductive exposure energy to be nominally the same for a given toner image regardless of said image transfer rate.

* * * * *